US007076904B1

(12) United States Patent
Rustick

(10) Patent No.: US 7,076,904 B1
(45) Date of Patent: Jul. 18, 2006

(54) DETACHABLE GUN BARREL ASSEMBLY

(76) Inventor: Joseph M. Rustick, 5133 N. Central Ave., Phoenix, AZ (US) 85012

( * ) Notice: Subject to any disclaimer, the term of this patent is extended or adjusted under 35 U.S.C. 154(b) by 0 days.

(21) Appl. No.: 10/453,205

(22) Filed: Jun. 2, 2003

Related U.S. Application Data

(60) Provisional application No. 60/387,157, filed on Jun. 6, 2002.

(51) Int. Cl.
*F41A 21/00* (2006.01)

(52) U.S. Cl. ..... 42/75.02; 42/75.01; 42/77; 89/14.05; 89/29

(58) Field of Classification Search ..... 45/75.02, 45/75.01, 77; 89/14.05, 29
See application file for complete search history.

(56) References Cited

U.S. PATENT DOCUMENTS

| | | | | | |
|---|---|---|---|---|---|
| 487,487 | A * | 12/1892 | Mason | 42/75.02 |
| 610,765 | A * | 9/1898 | Mason | 42/75.01 |
| 781,765 | A * | 2/1905 | Browning | 42/21 |
| 1,065,341 | A * | 6/1913 | Browning | 42/75.02 |
| 1,234,783 | A * | 7/1917 | Mauser | 42/76.01 |
| 1,393,057 | A * | 10/1921 | Vollmer | 89/16 |
| 1,494,524 | A * | 5/1924 | Adamson | 89/16 |
| 2,736,117 | A * | 2/1956 | Clarkson et al. | 42/75.02 |
| 2,950,653 | A * | 8/1960 | Harvey | 89/185 |
| 3,442,172 | A * | 5/1969 | Lorenz et al. | 89/16 |
| 4,445,265 | A * | 5/1984 | Olson et al. | 29/447 |
| 4,648,192 | A * | 3/1987 | Harness | 42/77 |
| 4,676,528 | A * | 6/1987 | Gray | 285/15 |
| 5,109,929 | A * | 5/1992 | Spears | 169/16 |
| 5,410,834 | A * | 5/1995 | Benton et al. | 42/75.02 |
| 6,655,372 | B1 * | 12/2003 | Field et al. | 124/83 |

* cited by examiner

*Primary Examiner*—M. Clement
(74) *Attorney, Agent, or Firm*—Parsons & Goltry; Robert A. Parsons; Michael W. Goltry

(57) ABSTRACT

A detachable gun barrel assembly having an adapter for threaded engagement with the receiver and a barrel dimensioned for affixation to the adapter. The adapter has a mating end section which threadedly engages the receiver V-threads and a receiving end section having square internal threads. The mating end section has a limit flange at its innermost end. The receiving end section has a larger internal diameter to form an internal flange or stop between sections. The barrel has an alignment section which inserts into the mating end section and contacts the limit flange. A securing section of the barrel is provided with a square external thread to engage the receiving end section and contact the internal flange. The elongated barrel is provided with an external shoulder which contacts the receiving end section upon affixation of barrel to adapter thereby providing a number of stops to maintain barrel alignment.

6 Claims, 1 Drawing Sheet

DETACHABLE GUN BARREL ASSEMBLY

CROSS REFERENCE TO RELATED APPLICATION

The present application is based on provisional patent application Ser. No. 60/387,157 filed Jun. 6, 2002.

BACKGROUND OF THE INVENTION

This invention relates to the provision of a detachable gun barrel assembly for a weapon wherein the accuracy of the weapon is maintained during repeated cycles of detachment and reattachment.

The novel assembly includes an adapter for affixation to the receiver of the weapon to enable the detachable barrel of the invention to be used with existing weapons. More particularly, the present invention is directed to the combination of the adapter and a detachable gun barrel having at one end at least three regions of differing diameters. Square threads are located on an intermediate region of the barrel end for attachment to the adapter. The adapter is comprised of two parts: first, a mating end section which is provided with vee-threads to interengage with the receiver and, second, a receiving end section which is provided with internal square threads to interengage with the detachable barrel.

The ability to reduce the size of a weapon by detaching the barrel from the receiver is an important feature in weapon transport, storage and maintenance. In addition, the rifling in a weapon barrel is known to wear as a result of repeated use often requiring replacement. One approach to solving this problem is to use a segmented barrel as shown in U.S. Pat. No. 4,546,564 which discloses the use of a threaded releaseable connection between barrel segments. As shown therein, the sections are provided with vee-threads bounded by chamfered ends to provide a mechanical stop and a gas seal between the segments. The use of vee-threads and chamfered surfaces is likely to result in uneven wearing during repeated use. As a result, the accuracy of the weapon degrades as the worn surfaces of the angled parts of the attachment structure allow relative movement therebetween. A similar type of two-part barrel construction with vee-threads is shown in U.S. Pat. No. 4,660,312 wherein chamfered surfaces are used to positively register the barrel sections together. Again, uneven wearing of angled surfaces over a period of time can result in a reduction in accuracy of the weapon.

Different constructions for gun barrels have been used to protect against wear occurring over periods of prolonged use including the use of a gun barrel liner as shown in U.S. Pat. No. 3,442,172. The patent teaches the use of particular metals to provide a barrel liner which is secured to the barrel by a combination of square threads and swaging to form the rifling in the liner. The square threads in combination with an internal shoulder provided in the barrel are used for attachment. The patent teaches the importance of securing the liner to the barrel to form a unitary structure so as to prevent distortion and maintain a close fit.

Accordingly, the present invention is directed to the provision of a detachable gun barrel assembly which includes an adapter for coupling a square threaded replaceable barrel to a conventional receiver of the type having vee-threads. In addition, the invention includes multiple limiting stops which aid in obtaining and maintaining the registration of the elongated barrel with the adapter. Thus, the repeated separation of the barrel from the adapter is accomplished without the wearing of angled contact surfaces. The use of square threads and orthogonal surface stops essentially eliminates the effect of wear through repeated detachments from adversely affecting the accuracy of the weapon.

SUMMARY OF THE INVENTION

The invention is concerned with a detachable barrel assembly for attachment to a receiver of a weapon wherein an adapter is provided for coupling the detachable barrel to the receiver. The adapter is a two section element including a mating end section of first length having a free end for threaded engagement with a receiver. The mating end section has a first diameter bore and a limit flange or stop at the free end thereof. The adapter also includes a receiving end section of second length and having a second diameter bore therethrough which is greater than the diameter of the bore of the mating end section. An internal flange is formed between the end sections. The receiving end section of the adapter is provided with a square internal thread.

The detachable barrel includes an attaching end for affixation to the adapter which comprises two sections located at the end of an elongated barrel. An alignment section is dimensioned for insertion into the mating end section so as to contact the limit flange. Next, a securing section is provided with a square external thread thereon for threaded engagement with the receiving end section of the adapter. Upon assembly, the securing section contacts the internal flange of the receiving end section.

The elongated section of the detachable barrel is dimensioned with an outside diameter which forms an external shoulder at the juncture of the securing section and the elongated section. The external shoulder contacts the receiving end section upon affixation of the detachable barrel to the adapter. When the barrel is completely attached, the alignment section contacts the limit flange, the securing section contacts the internal flange of the receiving end section and the external shoulder of the barrel is in contact with the receiving end section to provide three registration surfaces or limiting stops. The surfaces are orthogonal to the axis of the detachable barrel assembly. As a result, the wear surfaces of the contact areas of the assembly are comprised of the square thread surfaces and the three limiting stops. No angled surface is utilized in the assembly. As a result, wear through repeated detachment of the barrel from the adapter receiver does not result in angular displacement of the elongated barrel with respect to the receiver of the weapon. Consequently, accuracy is maintained over periods of repeated use with different barrels. The adapter once affixed to the receiver need not be removed in normal operating conditions.

Further features and advantages of the invention will become more readily apparent from the following detailed description of a preferred embodiment when taken in conjunction with the accompanying drawings.

DESCRIPTION OF THE PREFERRED EMBODIMENT

Figure 1:
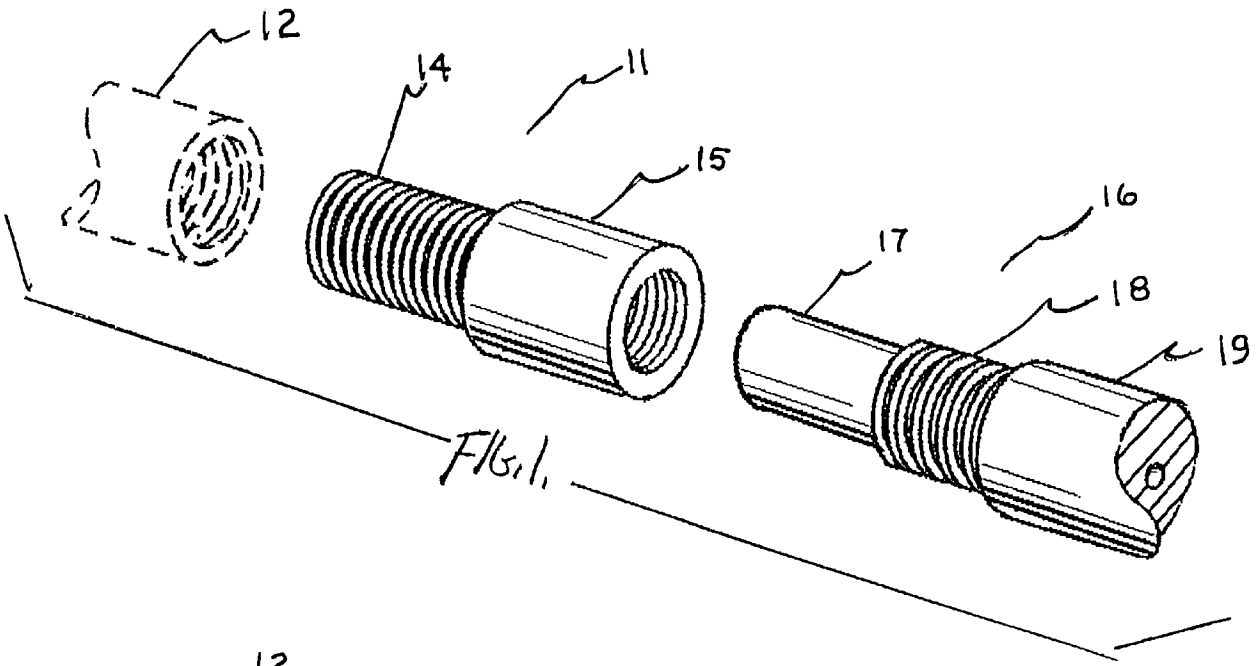
FIG. 1 is an exploded view in perspective of the preferred embodiment of the invention.

Referring now to FIG. 1, the detachable gun barrel assembly which is the subject of the present invention is shown comprising an adapter 11 dimensioned for attachment to receiver 12 shown in dashed outline. The receiver is an integral part of the weapon and is typically provided with internal vee-threads for receiving a detachable barrel. In the subject invention, the adapter 11 is provided with a mating end section 14 having vee-threads. However, the adapter may be made integral with the receiver if desired. In this case, the external threads of the adapter are not necessary. The adapter also includes a receiving end section 15 of larger internal and external diameters. The receiving end section of the adapter is provided with a square internal thread for engagement with a mating external thread on the detachable barrel. In use, the adapter remains attached to the receiver and the barrel is detached for weapon storage or transport. However, the adapter is capable of removal if so desired.

The detachable barrel 16 includes an attaching end which comprises an alignment section 17 that carries no thread but is dimensioned for insertion into mating end section 14. Adjacent to the alignment section 17 is a securing section 18 having a square external thread thereon. The elongated barrel section 19 is dimensioned with an outside diameter that forms an external shoulder at the juncture at the securing section and the barrel section.

Figure 2:
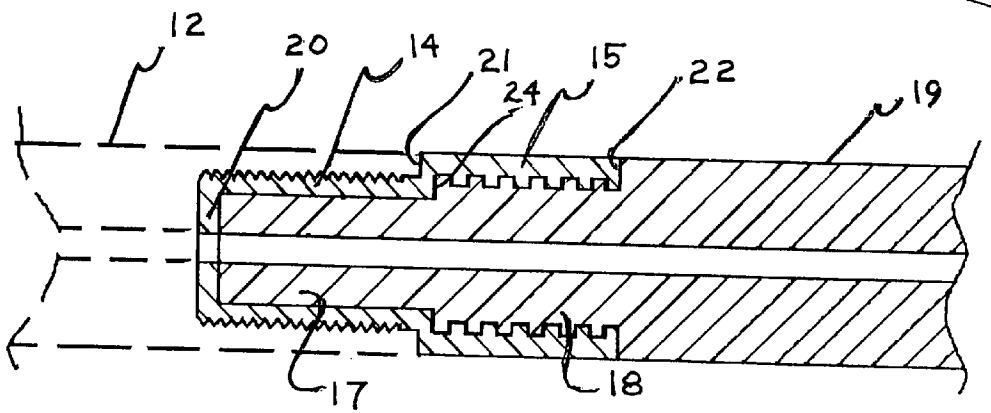
FIG. 2 is a cross sectional view of the embodiment of FIG. 1 showing the adapter and a portion of the barrel attached thereto.

In FIG. 2, the adapter and detachable barrel are shown interengaged one to another and to the receiver 12 shown in dashed outlined. The mating end section 14 of the adapter contains vee-threads and is inserted into the standard threads of the receiver 12. A limit flange or stop 20 is provided at the innermost end of the adapter and contacts the alignment section 17 of the detachable barrel. The securing section 18 of the detachable barrel has square external threads which interengage with the mating internal threads of receiving section 15.

When the parts are threadably engaged as shown, the external shoulder 21 of the adapter contacts the adjacent end of the receiver to position the adapter securely therein. The receiving end section 15 of the adapter has a diameter which is greater than the diameter of the adjacent mating section 14 thereby forming an internal flange or stop 24 between mating and receiving sections of the adapter. An external shoulder is formed at the juncture of the alignment section 17 and the securing section 18 of the barrel. The length of the alignment section 17 is equal to the length of the mating section 14 of the adapter to ensure that contact between adapter and barrel is made with the limit flange 20 and the internal flange 24.

The elongated barrel section 19 is dimensioned with an outside diameter which forms external shoulder 22 at the juncture of the securing section 18 and the elongated barrel section 19. The external shoulder 22 contacts the receiving end section 15 of the adapter to provide an additional stop for maintaining alignment of the detachable barrel, adapter and receiver during periods of extended use. The three stops provided by the limit flange 20, the internal flange 24 and the external shoulder 22 rely on surfaces that are orthogonal to the axis of the barrel. Similarly, the external threads of the receiving end section 15 of the adapter and securing section 18 of the detachable barrel utilize orthogonal surfaces for contact between adjacent parts. As a result, wear occurring from repeated detachment and reattachment of the barrel has essentially no impact on the alignment of the receiver, adapter and detachable barrel.

While the above description has referred to a specific embodiment of the invention, it is to be noted that modifications and variations may be made therein without departing from the scope of the invention.

What is claimed is:

1. A detachable barrel assembly received by a receiver of a weapon comprising:

(a) a weapon having a receiver;

(b) an adapter threadably engaged with the receiver, said adapter including;

i a threaded mating end section of first length having a free end received in the receiver, said mating end section having an inwardly extending limit flange at said free end, and ii a receiving end section of second length having an internal flange, said receiving end section having an internal thread therein; and (b) a detachable barrel having an attaching end affixed to the adapter, said detachable barrel including;

i an alignment section inserted into the mating end section, said alignment section contacting the limit flange;

ii a securing section having an external thread thereon for threaded engagement with the receiving end section, said securing section contacting the internal flange; and iii a barrel section having an outside diameter which forms an external shoulder at the juncture of the securing section and the barrel section, the external shoulder contacting the receiving end section of the detachable barrel to the adapter.

2. The detachable barrel assembly of claim 1 wherein said mating end section has a first diameter bore therethrough and said receiving end section has a second diameter bore therethrough.

3. The detachable barrel assembly of claim 2 wherein the diameter of the second bore is greater than the diameter of the first bore.

4. The detachable barrel assembly of claim 2 wherein said internal flange is provided between said mating end section and said receiving end section.

5. The detachable barrel assembly of claim 4 wherein said alignment section has a length
which provides contact with the limit flange of the mating section of the adapter.

6. The detachable barrel assembly of claim 5 wherein said securing section has a length to provide contact with the internal flange of the receiving end section.

* * * * *